US010699625B2

(12) United States Patent
Nonomura

(10) Patent No.: US 10,699,625 B2
(45) Date of Patent: Jun. 30, 2020

(54) DISPLAY DEVICE

(71) Applicant: SHARP KABUSHIKI KAISHA, Sakai, Osaka (JP)

(72) Inventor: Hajime Nonomura, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/205,150

(22) Filed: Nov. 29, 2018

(65) Prior Publication Data

US 2019/0172384 A1 Jun. 6, 2019

(30) Foreign Application Priority Data

Dec. 1, 2017 (JP) ..... 2017-231895

(51) Int. Cl.
*G09G 3/20* (2006.01)

(52) U.S. Cl.
CPC ... *G09G 3/2018* (2013.01); *G09G 2320/0276* (2013.01); *G09G 2320/064* (2013.01); *G09G 2320/0646* (2013.01); *G09G 2360/16* (2013.01)

(58) Field of Classification Search
CPC ..... G09G 3/2018; G09G 2320/0646; G09G 2320/0276; G09G 2320/064; G09G 2360/16
See application file for complete search history.

(56) References Cited

U.S. PATENT DOCUMENTS

2007/0139406 A1* 6/2007 Ozawa ..... G09G 3/3233 345/211
2008/0068328 A1 3/2008 Jou et al.
2009/0225072 A1 9/2009 Mizukoshi et al.
2010/0265228 A1* 10/2010 Kimura ..... G09G 3/3233 345/207
2013/0342585 A1* 12/2013 Chun ..... G09G 3/3208 345/690
2016/0232852 A1* 8/2016 An ..... G09G 3/20

FOREIGN PATENT DOCUMENTS

JP 2007-156045 A 6/2007
JP 2009-216801 A 9/2009
TW 200813948 A 3/2008

* cited by examiner

*Primary Examiner* — Brent D Castiaux
(74) *Attorney, Agent, or Firm* — ScienBiziP, P.C.

(57) ABSTRACT

A display device includes an auto current limiter (ACL) circuit and a luminance control circuit. The ACL circuit acquires a first parameter on the basis of luminance-related data of input image data, and then acquires a second parameter by applying a luminance control parameter from the luminance control circuit to the first parameter. The ACL circuit corrects the input image data by a second correction function acquired from the second parameter.

4 Claims, 6 Drawing Sheets

FIG. 2

S1

CALCULATE LUMINANCE (L) OF ONE PIXEL UNIT ON BASIS OF EXPRESSION (1) BELOW $$L = CVF_R \times R + CVF_G \times G + CVF_B \times B \quad (1)$$

CVF_R, CVF_G, AND CVF_B: LUMINANCE COEFFICIENTS; CVF_R = 0.299, CVF_G = 0.587, CVF_B = 0.114
R, G, AND B: PIECES OF GRAY-LEVEL DATA (10 BITS) FOR R PIXEL, G PIXEL, AND B PIXEL CONSTITUTING ONE PIXEL
L: LUMINANCE (10 BITS) OF ONE PIXEL UNIT

↓

S2

ADD UP LUMINANCES (L) FOR ONE FRAME ON BASIS OF EXPRESSION (2) BELOW AND CALCULATE FRAME LUMINANCE (Lf)

$$\mathbf{Lf} = \sum_{(x,y)=(0,0)}^{\mathbf{width,line}} \mathbf{L(x,y)} \quad (2)$$

width: THE NUMBER OF PIXELS IN X DIRECTION
line: THE NUMBER OF PIXELS IN Y DIRECTION
(x,y): COORDINATES OF PIXEL
Lf: FRAME LUMINANCE

↓

S3

CALCULATE LIGHTING RATE ON BASIS OF EXPRESSION (3) BELOW
(MULTIPLY BY 1023 TO NORMALIZE TO 10 BITS)

$$\text{LIGHTING RATE} = \frac{\mathbf{Lf}}{\mathbf{width \times line \times 1023}} \times \mathbf{1023} \quad (3)$$

| LIGHTING RATE | INFLECTION POINT | END POINT | CONTROL POINT X | CONTROL POINT Y |
|---|---|---|---|---|
| 0 | IP_1 | EP_1 | XCP_1 | YCP_1 |
| 150 | IP_2 | EP_2 | XCP_2 | YCP_2 |
| 300 | IP_3 | EP_3 | XCP_3 | YCP_3 |
| 450 | IP_4 | EP_4 | XCP_4 | YCP_4 |
| 600 | IP_5 | EP_5 | XCP_5 | YCP_5 |
| 750 | IP_6 | EP_6 | XCP_6 | YCP_6 |
| 900 | IP_7 | EP_7 | XCP_7 | YCP_7 |
| 1023 | IP_8 | EP_8 | XCP_8 | YCP_8 |

FIG. 5A
FIG. 5B
FIG. 5C
FIG. 5D
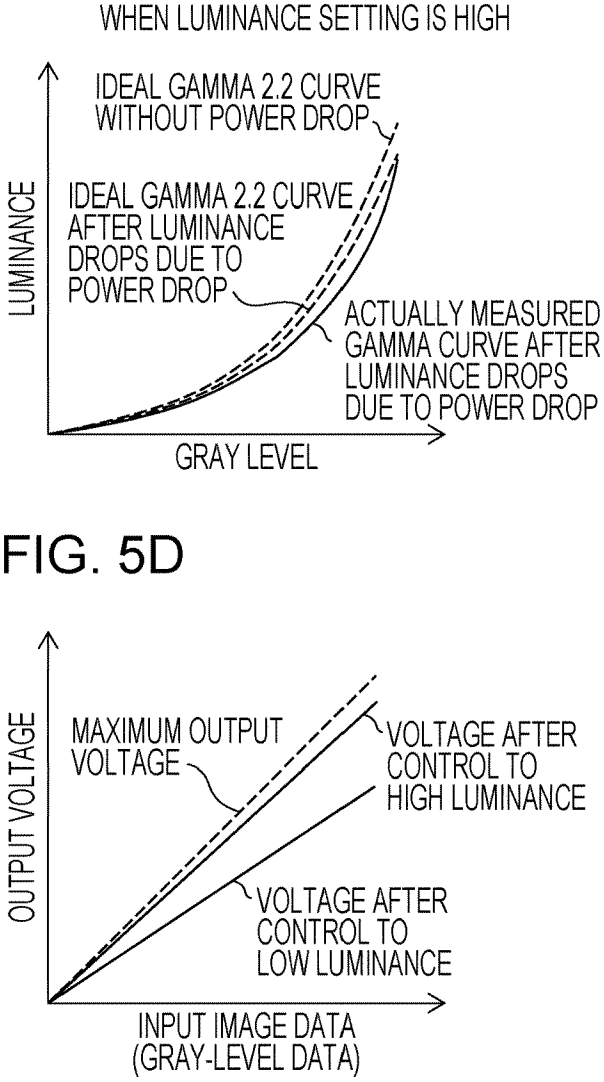
FIG. 5E
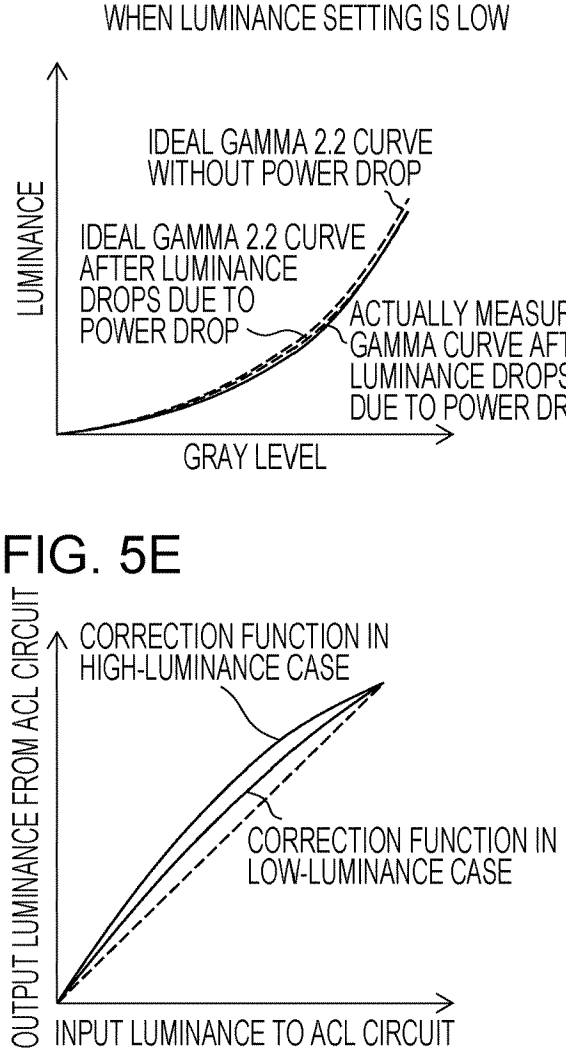
FIG. 5F
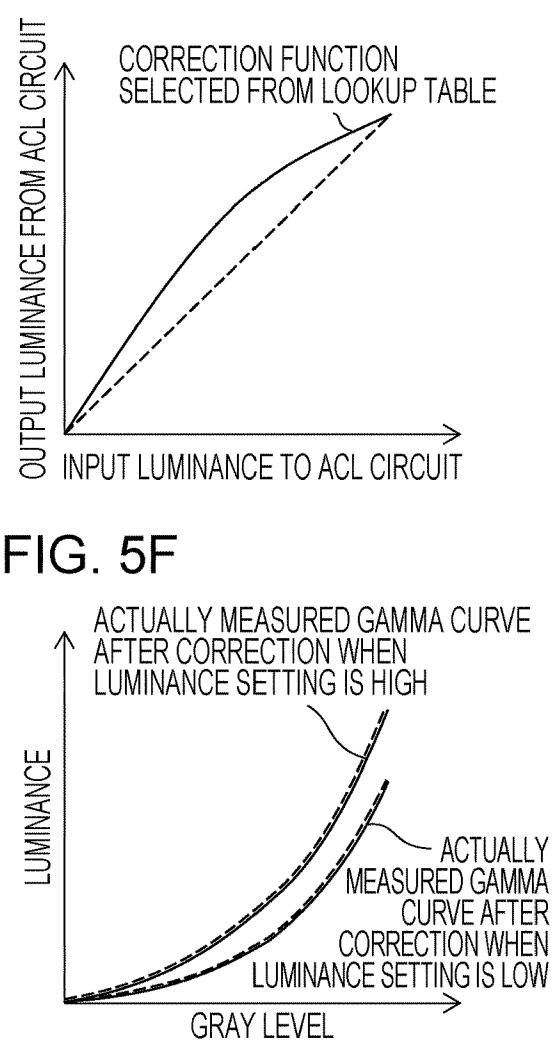

DISPLAY DEVICE

BACKGROUND

1. Field

The present disclosure relates to a display device.

2. Description of the Related Art

An organic electro luminescence (EL) display has been known as thin, high-quality, and low-power-consumption display devices. In the organic EL display, a plurality of pixel circuits, each including an organic EL element as a self-luminous display element driven by current and a driving (controlling) transistor for driving the organic EL element, are arranged in a matrix.

For example, if an organic EL display displays a bright screen, many pixels light up at high luminance levels which increases the amount of drive current and power consumption. In this case, a decline in the performance of a power supply which supplies power to an organic EL panel, that is, occurrence of a power drop, wiring resistance, or the like causes the problem of a reduction in a voltage supplied to the organic EL panel and the problem of a decline in display quality due to a reduction in the luminance of the organic EL display.

Japanese unexamined Patent Application Publication No. 2009-216801 (laid open on Sep. 24, 2009) discloses a display device which corrects input pixel data with correction data so as to soften the impact of a voltage drop on current. The display device disclosed in Japanese Unexamined Patent Application Publication No. 2009-216801 is configured to correct pieces of pixel data while performing voltage drop calculation in accordance with the order in which the pieces of pixel data are supplied.

Japanese Unexamined Patent Application Publication No. 2007-156045 (laid open on Jun. 21, 2007) proposes a lookup table storing all gray-level values corresponding to a variable range for pixel data and values of power to be consumed by a self-luminous element for light emission at the gray-level values in association with each other and a method for detecting power consumption for overall display by referring to the lookup table, obtaining values of power consumed for respective pieces of pixel data, and adding up the power values for each frame to calculate a per-frame power consumption value.

A cumulative value of gray-level values of respective pixels for one frame or the cumulative number of pixels, whose gray-level values exceed a threshold, can be used to estimate power consumption of a display pattern (display screen), for example. Both the correction method described in Japanese Unexamined Patent Application Publication No. 2009-216801 and the power consumption detection method described in Japanese Unexamined Patent Application Publication No. 2007-156045 calculate an estimate of power consumption using input gray-level voltage data before change as gray-level voltage data to be actually used without change.

A problem with a case where an estimate of power consumption is calculated using input gray-level voltage data before change as gray-level voltage data to be actually used without change is calculated will be described below.

FIG. 7 is a graph showing a case where input gray-level voltage data is subjected to gamma voltage change in a luminance control circuit.

As shown in FIG. 7, voltages corresponding to a gray level of n differ between before gamma voltage change of the input gray-level voltage data in the luminance control circuit, that is, a case where the input gray-level voltage data is not subjected to the gamma voltage change and after the gamma voltage change of the input gray-level voltage data in the luminance control circuit, that is, a case where the input gray-level voltage data is subjected to the gamma voltage change. The cases are also different in power consumption.

Thus, if an estimate of power consumption is calculated not on the basis of gray-level voltage data after gamma voltage change in the luminance control circuit, that is, gray-level voltage data subjected to the gamma voltage change but on the basis of gray-level voltage data before the gamma voltage change in the luminance control circuit, that is, gray-level voltage data not subjected to the gamma voltage change, as in Japanese Unexamined Patent Application Publication No. 2009-216801 and Japanese Unexamined Patent Application Publication No. 2007-156045, correction corresponding to a change in power consumption due to the gamma voltage change in the luminance control circuit is incapable of being reflected in input gray-level voltage data.

The present disclosure has been made in view of the above-described problem, and it is desirable to provide a display device capable of reflecting correction corresponding to a change in power consumption associated with control of the luminance of a display panel performed by a luminance control circuit in input image data.

SUMMARY

According to an aspect of the disclosure, there is provided a display device including a display panel, a gray-level correction circuit, and a luminance control circuit which controls luminance of the display panel. The gray-level correction circuit acquires a first parameter for generating a first correction function on the basis of luminance-related data of input image data, and corrects the first parameter on the basis of a luminance control parameter related to control of the luminance of the display panel from the luminance control circuit, acquires a second parameter for generating a second correction function, and corrects a gray level of the input image data on the basis of the second correction function.

It is possible to implement provision of a display device capable of reflecting correction corresponding to a change in power consumption associated with control of the luminance of a display panel performed by a luminance control circuit in input image data.

BRIEF DESCRIPTION OF THE DRAWINGS

FIG. 2 is a diagram for explaining steps of calculating a lighting rate in a lighting rate calculation unit provided in the display device shown in FIG. 1;

FIGS. 5A to 5F are graphs for explaining correction to be performed by an ACL circuit in a case where the luminance control circuit sets the display luminance of a display panel high and correction to be performed by the ACL circuit in a case where the luminance control circuit sets the display luminance low;

DESCRIPTION OF THE EMBODIMENTS

Figure 1:
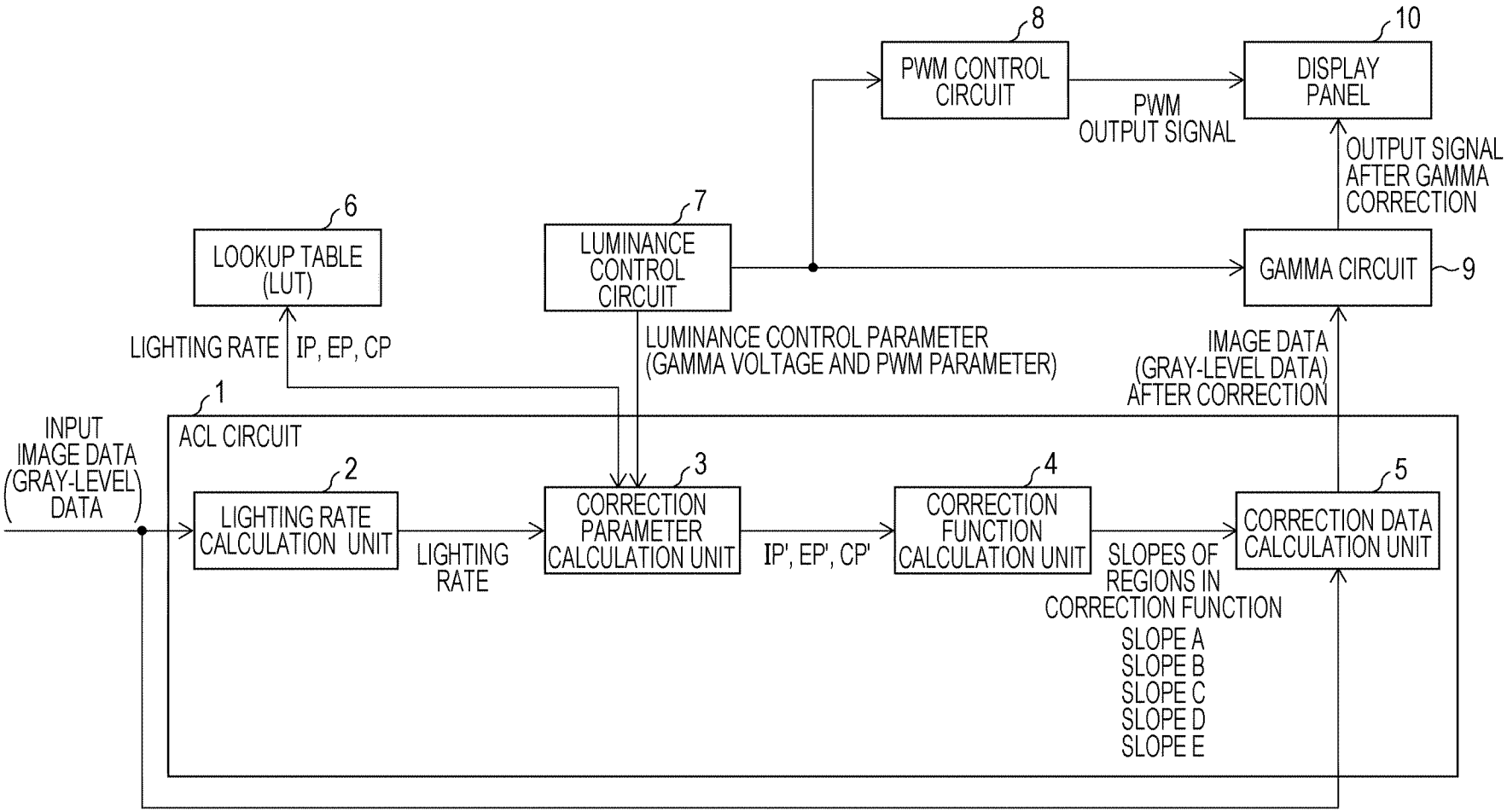
FIG. 1 is a diagram showing a circuit configuration of a display device according to a first embodiment of the present disclosure.

Embodiments of the present disclosure will be described as follows with reference to FIGS. 1 to 6. For convenience of description, components having the same functions as those of components described in a particular embodiment are denoted by same reference numerals, and a description thereof may be omitted.

Note that although the following embodiments will be described in the context of an organic EL display device including an organic EL element, which is a self-luminous display element driven by current, as an example of a display element provided in a display device, the present disclosure is not particularly limited as long as the display device is a display device including a display element whose power consumption changes in accordance with the amount of light emission.

First Embodiment

An organic EL display device according to a first embodiment of the present disclosure will be described below with reference to FIGS. 1 to 5F.

Organic EL Display Device

FIG. 1 is a diagram showing a circuit configuration of the organic EL display device.

As shown in FIG. 1, the organic EL display device is provided with an auto current limiter (ACL) circuit 1 including a lighting rate calculation unit 2, a correction parameter calculation unit 3, a correction function calculation unit 4, and a correction data calculation unit 5, a lookup table (LUT) 6, a luminance control circuit 7, a pulse width modulation (PWM) control circuit 8, a gamma circuit 9, and a display panel 10.

The lighting rate calculation unit 2 calculates a lighting rate (to be described later in detail) on the basis of input image data (gray-level data) and outputs the lighting rate to the correction parameter calculation unit 3.

The correction parameter calculation unit 3 refers to the lookup table (LUT) 6 in accordance with the lighting rate calculated by the lighting rate calculation unit 2 and acquires parameters (an IP, an EP, and a CP; first parameter for generating a correction function (first correction function) of output luminance (output gray level) with respect to input luminance (input gray level) for the lighting rate.

The correction parameter calculation unit 3 then applies a luminance control parameter (a gamma voltage (a gamma voltage setup value) and a PWM parameter) which are obtained from the luminance control circuit 7 to the parameters (the IP, EP, and CP), acquires final parameters (an IP', an EP', and a CP'; second parameters) for generating a correction function (second correction function) of output luminance (output gray level) with respect to input luminance (input gray level), in which correction corresponding to luminance control is reflected, and outputs the final parameters to the correction function calculation unit 4.

The correction function calculation unit 4 calculates a correction function from the final parameters (the IP', EP', and CP') through curve fitting, acquires respective slopes (SLOPE A to SLOPE E) of regions in the correction function, and outputs the slopes to the correction data calculation unit 5.

The correction data calculation unit 5 outputs image data (gray-level data) after correction obtained by correcting the input image data (gray-level data) on the basis of the respective slopes (SLOPE A to SLOPE E) of she regions in the correction function obtained from the correction function calculation unit 4.

The luminance control circuit 7 controls the PWM control circuit 8 and the gamma circuit 9 on the basis of the luminance control parameter (the gamma voltage (gamma voltage setup value) and the PWM parameter) output to the correction parameter calculation unit 3 and controls the luminance of the display panel 10. That is, the luminance control circuit 7 supplies the PWM parameter to the PWM control circuit 8 and the gamma voltage (gamma voltage setup value) to the gamma circuit 9.

The PWM control circuit 8 is set to the prescribed PWM parameter in advance by the luminance control circuit 7. The PWM control circuit 8 outputs a PWM output signal based on the prescribed PWM parameter to the display panel 10.

The gamma circuit 9 is set to the prescribed gamma value (gamma voltage setup value) (a gamma value of 2.2 in the present embodiment) in advance by the luminance control circuit 7. The gamma circuit 9 outputs an output signal after gamma correction based on the prescribed gamma value (gamma voltage setup value) to the display panel 10.

In the present embodiment, the display panel 10 is an organic EL display panel including an organic EL element which is a self-luminous display element. A case where an R pixel including a red-light-emitting organic EL element, a G pixel including a green-light-emitting organic EL element, and a B pixel including a blue-light-emitting organic EL element constitute one pixel will be described as an example. The present disclosure, however, is not limited to this.

Lighting Rate Calculation Unit

FIG. 2 is a diagram for explaining steps of calculating a lighting rate in the lighting rate calculation unit 2.

In step 1 (S1) shown in FIG. 2, a luminance (L) of each pixel unit composed of one R pixel, one G pixel, and one B pixel is calculated on the basis of expression (1) in FIG. 2.

The present embodiment describes, as an example, a case where $CVF_{13}$ R=0.299, CVF_G=0.587, and CVF_B=0.114 are used as luminance coefficients for the respective colors.

The present embodiment, however, is not limited to this as long as the total of the luminance coefficients for the respective colors is 1.

The present embodiment also describes, as an example, a case where R, G, and B in expression (1) in FIG. 2 represent 10-bit pieces of gray-level data for an R pixel, a G pixel, and a B pixel, respectively, and L represents a 10-bit piece of luminance data indicating a luminance of one pixel unit composed of the R pixel, the C pixel, and the B pixel. The sizes of the pieces of gray-level data and the piece of luminance data, however, are not limited to 10 bits.

In step 2 (S2) shown in FIG. 2, luminances (L) of pixel units for one frame are added up on the basis of expression (2) in FIG. 2 to calculate a frame luminance (Lf).

In expression (2) in FIG. 2, width represents the number of pixels in an X direction of the display panel 10, line represents the number of pixels in a Y direction of the display panel 10, and (x,y) represents coordinates of a given pixel of the display panel 10.

In step 3 (S3) shown in FIG. 2, a lighting rate is calculated on the basis of expression (3) in FIG. 2.

As described above, the lighting rate calculation unit 2 can calculate a lighting rate normalized to a 10-bit piece of data by step 1 (S1) to step 3 (S3) described above.

Note that although the present embodiment has described, as an example, a case where a lighting rate normalized to a 10-bit piece of data is calculated, the present disclosure is not limited to this.

Lookup Table (LUT)

Figures 3A, 3B:
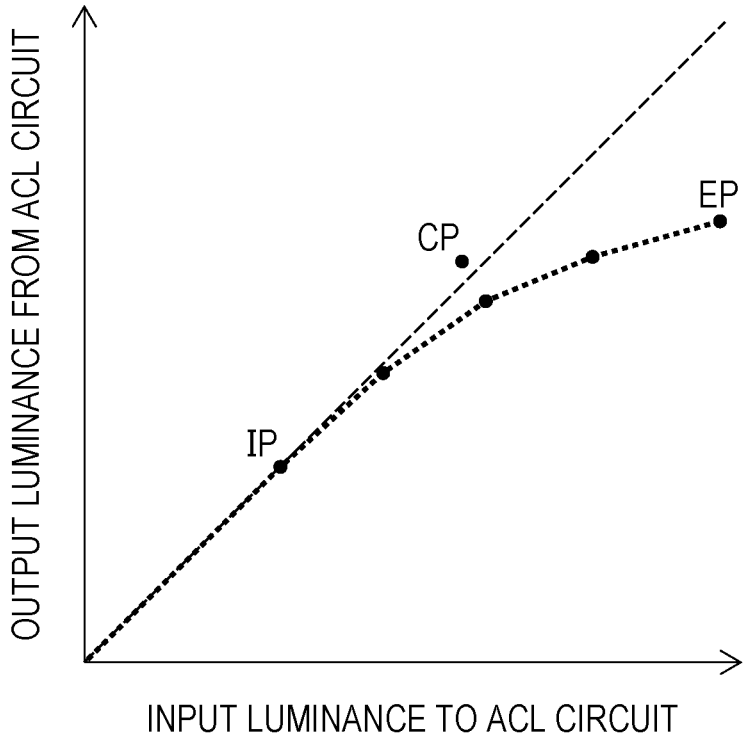
FIG. 3A is a chart showing parameters for generating a correction function of output luminance with respect to input luminance for each of lighting rates stored in a lookup table provided in the display device shown in FIG. 1.
FIG. 3B is a graph showing an example of a correction function based on parameters of output luminance with respect to input luminance.

FIG. 3A is a chart showing parameters for generating a correction function of output luminance (output gray level) with respect to input luminance (input gray level) for each of lighting rates stored in the lookup table (LUT) 6. FIG. 3B is a graph showing an example of the correction function of output luminance (output gray level) with respect to input luminance (input gray level) based on the parameters.

As shown in FIG. 3A, the lookup table (LUT) 6 stores parameters for generating a plurality of correction functions of output luminance with respect to input luminance, one of which is selected in accordance with a lighting rate. The lookup table (LUT) 6 is created on the basis of a relationship between lighting rate and correction amount calculated through a prior assessment performed when the luminance control parameter (the gamma voltage (gamma voltage setup value) and the PWM parameter) has a given value.

That is, a desirable correction function for each lighting rate is calculated in advance through, for example, a prior assessment of the display panel 10, and parameters for generating the desirable correction function for the lighting rate are stored in the lookup table (LUT) 6.

The present embodiment has described, as an example, a case where lighting rates are divided into eight ranges and parameters for generating a plurality of correction functions of output luminance with respect to input luminance are stored in the lookup table (LUT) 6. The present disclosure, however, is not limited to this. Lighting rates may be divided into a plurality of ranges, and parameters for generating a plurality of correction functions of output luminance with respect to input luminance may be stored.

Note that 0, 150, . . . , 900, and 1023 are used as boundary values in a case where lighting rates are divided into plurality of ranges in the present embodiment. The present disclosure, however, is not limited to this, and the boundary values can be appropriately set.

Parameters for generating a correction function are three points, an inflection point (IP), a control point (CP), and an end point (EP).

As shown in FIG. 3A, in the present embodiment, the IP has X and Y coordinates which are the same in terms of specifications and design scale. The EP is a point for a gray level of 1023 and is substantially fixed (to 1023) in the X direction. The CP is defined by a control point X and a control point Y. Although this case will be described as an example, the present disclosure is not limited to this.

FIG. 3B shows a given correction function among the plurality of correction functions of output luminance with respect to input luminance described above. The correction function forms a straight line on a low luminance (low input gray level) side and is smoothly corrected with a fitted curve on a high luminance (high input gray level) side.

For example, in the case of a lighting rate of 150, a fitted curve determined from three points, an IP defined by IP_2, an EP defined by EP_2, and a CP defined by XCP_2 and YCP_2, is used. In the case of a lighting rate of 900, a fitted curve determined from three points, an IP defined by IP_7, an EP defined by EP_7, and a CP defined by XCP_7 and YCP_7, is used.

At the time of determining a fitted curve from three points as described above, a straight line specified by the three points is bent to fit a curve while connecting each midpoint between two points. As shown in FIG. 3B, a correction function (correction curve) of output luminance (output gray level) with respect to input luminance (input gray level) based on three points as described above for a particular lighting rate can be obtained.

A linear gray-level correction function with a CP set on a straight line connecting an EP and an IP may be adopted.

Note that an IP refers to a start point of a fitted curve, an EP refers to a maximum luminance point (an end point of the fitted curve), and a CP is a calculation point for calculating the fitted curve. For example, if the CP is set on the Straight line connecting the EP and the IP, a correction function forms a straight line.

In the present embodiment, if a lighting rate calculated by the lighting rate calculation unit 2 is 0, parameters corresponding to a lighting rate of 0 in the lookup table (LUT) 6 are referred to. If the lighting rate is 150, parameters corresponding to the lighting rate of 150 in the lookup table (LUT) 6 are referred to. If the lighting rate is 300, parameters corresponding to a lighting rate of 300 in the lookup table (LUT) 6 are referred to. If the lighting rate is 450, parameters corresponding to a lighting rate of 450 in the lookup table (LUT) 6 are referred to. If the lighting rate is 600, parameters corresponding to a lighting rate of 600 in the lookup table (LUT) 6 are referred to. If the lighting rate is 750, parameters corresponding to a lighting rate of 750 in the lookup table (LUT) 6 are referred to. If the lighting rate is 900, parameters corresponding to the lighting rate of 900 in the lookup table (LUT) 6 are referred to. If the lighting rate is 1023, parameters corresponding to a lighting rate of 1023 in the lookup table (LUT) 6 are referred to.

In the present embodiment, if the lighting rate is not less than 1 and less than 150, if the lighting rate is not less than 151 and less than 300, if the lighting rate is not less than 301 and less than 450, if the lighting rate is not less than 451 and less than 600, if the lighting rate is not less than 601 and less than 750, if the lighting rate is not less than 751 and less than 900, or if the lighting rate is not less than 901 and less than 1023, for example, if the lighting rate is 50, parameters corresponding to a lighting rate of 50 are calculated through linear interpolation.

More specifically, if the lighting rate is 50, values obtained by multiplying differences (IP_2−IP_1, EP_2−EP_1, XCP_2−XCP_1, and YCP_2−YCP_1) between values of parameters corresponding to the lighting rate of 0, IP_1, EP_1, XCP_1, and YCP_1, and values of parameters corresponding to the lighting rate of 150, IP_2, EP_2, XCP_2, and YCP_2, shown in FIG. 3A by 50/(150−0) are used as corresponding parameters.

Note that calculation of parameters using such linear interpolation can be performed by the correction parameter calculation unit 3 provided in the ACL circuit 1.

Correction Parameter Calculation Unit and Correction Function Calculation Unit The correction parameter calculation unit 3 refers to the lookup table (LUT) 6 in accordance with a lighting rate calculated by the lighting rate calculation unit 2 and acquires parameters (an IP, an EP, and a CP) for generating a correction function of output luminance (output gray level) with respect to input luminance (input gray level) for the lighting rate.

The correction parameter calculation unit 3 applies a luminance control parameter (a gamma voltage and a PWM parameter) obtained from the luminance control circuit 7 to the parameters (the IP, EP, and CP), acquires final parameters (an IP', an EP', and a CP') for generating a correction function of output luminance (output gray level) with respect to input luminance (input gray level), in which correction corresponding to luminance control is reflected, and outputs the final parameters to the correction function calculation unit 4.

Figure 4A:
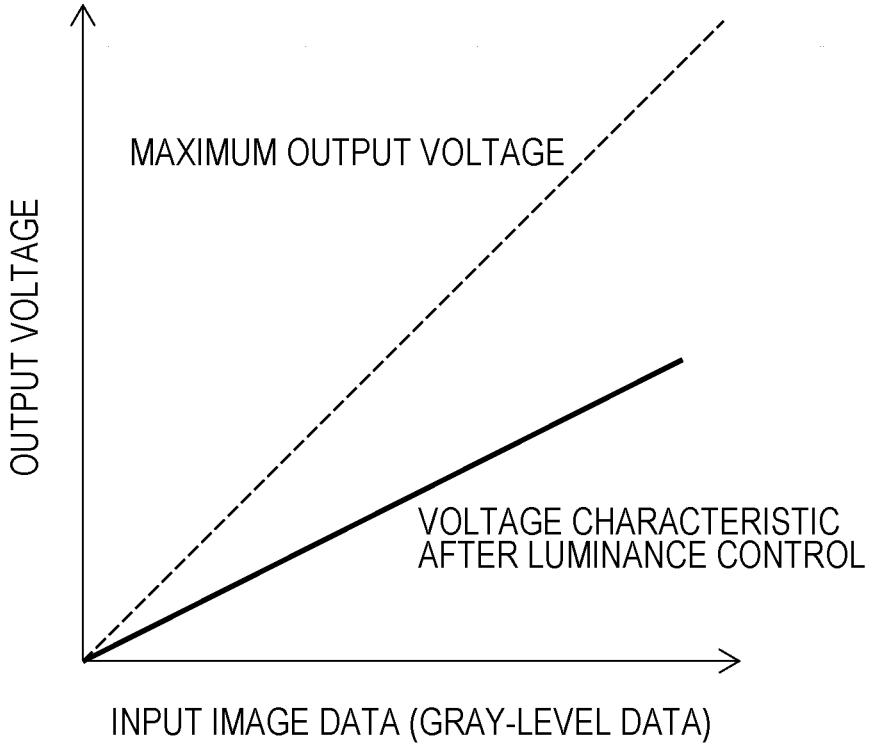
FIG. 4A is a graph showing an example of a relationship between input image data (gray-level data) and output voltage after a luminance control circuit provided in the display device shown in FIG. 1 performs luminance control.

FIG. 4A is a graph showing an example of a relationship between input image data (gray-level data) and output voltage after the luminance control circuit 7 performs luminance control.

As shown in FIG. 4A, even if the input image data (gray-level data) is a 10-bit piece of data of, for example, 0 to 1023 and is a piece of gray-level data indicating a gray level of, for example, 500, an output voltage and power consumption is totally different between before and after luminance control using the gamma voltage and the PWM parameter. The amount of reduction in luminance in the display panel 10 due to a power drop, wiring resistance, or the like is also totally different.

Thus, if an estimate of power consumption is calculated only on the basis of the input image data (gray-level data) that is a piece of data before luminance control, correction corresponding to a change in power consumption due to luminance change in the luminance control circuit 7 is incapable of being reflected in the input image data (gray-level data).

For this reason, in the present embodiment, the correction parameter calculation unit 3 is configured to apply the luminance control parameter (the gamma voltage and the PWM parameter) obtained from the luminance control circuit 7 to the parameters (the IP, EP, and CP) and acquire the final parameters (the IP', EP', and CP') for generating a correction function of output luminance (output gray level) with respect to input luminance (input gray level), in which correction corresponding to luminance control is reflected.

The correction parameter calculation unit 3 multiples the parameters (the IP, EP, and CP) by an approximation coefficient appropriate for the luminance control parameter (the gamma voltage and the PWM parameter) obtained from the luminance control circuit 7 to acquire the final parameters (the IP', EP', and CP').

Note that the approximation coefficient appropriate for the luminance control parameter (the gamma voltage and the PWM parameter) obtained from the luminance control circuit 7 may be stored in the lookup table (LUT) 6.

The present embodiment describes, as an example, a case where the luminance control parameter (the gamma voltage and the PWM parameter) obtained from the luminance control circuit 7 is an 8-bit piece of data. The present disclosure, however, is not limited to this.

The case of FIG. 4A assumes that the luminance control circuit 7 performs luminance control such that the display luminance of the display panel 10 is 50%.

Thus, if the parameters stored in the lookup table (LUT) 6 for generating a plurality of correction functions of output luminance with respect to input luminance, one of which is selected in accordance with the lighting rate, are created on the basis of a relationship between lighting rate and correction amount calculated through a prior assessment performed when the luminance control parameter is 255, a value of the luminance control parameter corresponding to a display luminance of 50% is 127, and values obtained by multiplying Y-axis components of the parameters (the IP, EP, and CP) acquired from the lookup table (LUT) 6 by 0.5 that is an approximation coefficient corresponding to 127/255 (=50%) can be set as the parameters after correction (the IP', EP', and CP'). The correction parameter calculation unit 3 outputs the parameters after correction (the IP', EP', and CP') to the correction function calculation unit 4.

Figure 4B:
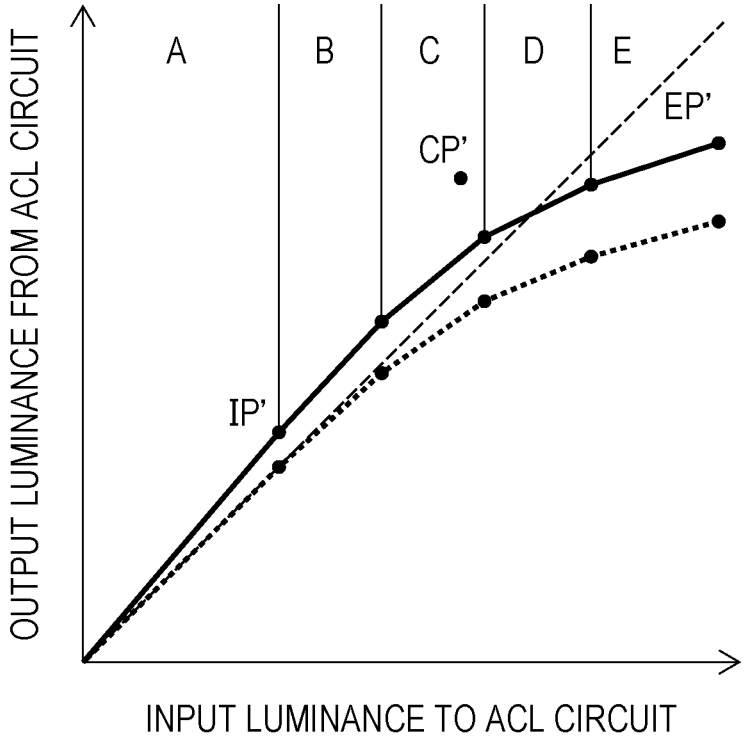
FIG. 4B is a graph showing a correction function of output luminance with respect to input luminance obtained by making a correction corresponding to luminance control to the correction function of output luminance with respect to input luminance shown in FIG. 3B.

FIG. 4B is a graph showing a correction function of output luminance (output gray level) with respect to input luminance (input gray level) obtained by making a correction corresponding to luminance control to the correction function of output luminance (output gray level) with respect to input luminance (input gray level) shown in FIG. 3B.

The correction function calculation unit 4 obtains a smooth gray-level correction function using a fitted curve obtained from the parameters after correction (the IP', EP', and CP'), as shown in FIG. 4B, determines slopes (SLOPE A to SLOPE E) of five regions A to E in the obtained gray-level correction function, and outputs the slopes to the correction data calculation unit 5.

Note that the parameters stored in the lookup table (LUT) 6 shown in FIG. 3 for generating a plurality of correction functions of output luminance with respect to input luminance, one of which is selected in accordance with the lighting rate, are created on the basis of a relationship between lighting rate and correction amount calculated through a prior assessment performed when the luminance control parameter is 127 for an intermediate gray level. The parameters after correction (the IP', EP', and CP') shown in FIG. 4B are for a case where the luminance control parameter is larger than 127 and are obtained by multiplying the Y-axis components of the parameters (the IP, EP, and CP) acquired from the lookup table (LUT) 6 by a corresponding approximation coefficient.

Correction Data Calculation Unit

The correction data calculation unit 5 outputs image data (gray-level data) after correction obtained by correcting input image data (gray-level data) on the basis of the slopes (SLOPE A TO SLOPE E) of the five regions A to E in the gray-level correction function obtained from the correction function calculation unit 4.

FIGS. 5A to 5F are graphs for explaining correction to be performed by the ACL circuit 1 in a case where the luminance control circuit 7 sets the display luminance of the display panel 10 high and correction to be performed by the ACL circuit 1 in a case where the luminance control circuit 7 sets the display luminance low.

FIGS. 5A and 5B are graphs showing relationships between gray level and luminance when the same image is displayed on the display panel 10, that is, when an image corresponding to a lighting rate of, for example, 700 is displayed.

FIG. 5A shows a case where the luminance control circuit 7 sets a luminance setting high such that a gray level of 255 corresponds to a luminance of 700 cd. The case of FIG. 5B is a case where the luminance control circuit 7 sets the luminance setting low such that the gray level of 255 corresponds to a luminance of 500 cd.

If the luminance control circuit 7 makes settings such that the gray level of 255 corresponds to the luminance of 700 cd, as shown in FIG. 5A, a luminance for the gray level of 255 drops to about 650 cd due to a power drop, and an actually measured gamma curve (a solid line) deviates largely from an ideal gamma 2.2 curve with a power drop (a dotted line) or an ideal gamma 2.2 curve without a power drop (a dotted line).

If the luminance control circuit 7 makes settings such that the gray level of 255 corresponds to the luminance of 500 cd, as shown in FIG. 5B, the luminance for the gray level of 255 drops to about 490 cd due to a power drop, and an actually measured gamma curve (a solid line) deviates only slightly from an ideal gamma 2.2 curve with a power drop (a dotted line) or an ideal gamma 2.2 curve without a power drop (a dotted line).

FIG. 5C shows one of correction functions of output luminance with respect to input luminance, which are generated from sets of parameters, which are stored in the lookup table (LUT) 6 and one of which is selected in accordance with the lighting rate, and shows a case where the lighting rate is 700, and the sets of parameters, which are stored in the lookup table (LUT) 6 and one of which is selected in accordance with the lighting rate, are created on the basis of a relationship between lighting rate and correction amount calculated through a prior assessment performed when the luminance control parameter is 255.

The lighting rate does not change regardless of whether the luminance control circuit 7 sets the luminance setting high or low. Parameters (an IP, an EP, and a CP) (first parameters) for generating the one correction function (a first correction function) shown in FIG. 5C are selected on the basis of the lighting rate.

FIG. 5D is a graph showing an example of a relationship between input image data (gray-level data) and output voltage in a case where the luminance control circuit 7 makes settings such that the gray level of 255 corresponds to the luminance of 700 cd and an example of a relationship between input image data (gray-level data) and output voltage in a case where the luminance control circuit 7 makes settings such that the gray level of 255 corresponds to the luminance of 500 cd.

FIG. 5E shows correction functions (second correction functions) which are each generated from parameters after correction (an IP', an EP', and a CP') (second parameters) obtained by multiplying Y-axis components of the parameters (the IP, EP, and CP) (the first parameters) selected in accordance with the lighting rate by a corresponding approximation coefficient to reflect correction corresponding to a change in power consumption associated with control of the luminance of the display panel 10 performed by the luminance control circuit 7.

A correction function in a high-luminance case in FIG. 5E is a correction function in a case where the luminance control circuit 7 makes settings such that the gray level of 255 corresponds to the luminance of 700 cd. A correction function in a low-luminance case in FIG. 5E is a correction function in a case where the luminance control circuit 7 makes settings such that the gray level of 255 corresponds to the luminance of 500 cd.

FIG. 5F shows an actually measured gamma curve after correction when the luminance setting is high, that is, in a case where the luminance control circuit 7 makes settings such that the gray level of 255 corresponds to the luminance of 700 cd and an actually measured gamma curve after correction when the luminance setting is low, that is, in a case where the luminance control circuit 7 makes settings such that the gray level of 255 corresponds to the luminance of 500 cd. The actually measured gamma curve after correction when the luminance setting is high coincides substantially with the ideal gamma 2.2 curve with a power drop when the luminance setting is high (a dotted line). The actually measured gamma curve after correction when the luminance setting is low coincides substantially with the ideal gamma 2.2 curve with a power drop when the luminance setting is low (a dotted line).

As described above, the organic EL display device according to the present embodiment includes the ACL circuit (gray-level correction circuit) 1 including the lighting rate calculation unit 2, the correction parameter calculation unit 3, the correction function calculation unit 4, and the correction data calculation unit 5, the lookup table (LUT) 6, the luminance control circuit 7, the PWM control circuit 8, the gamma circuit 9, and the display panel 10. It is thus possible to implement provision of an organic EL display device capable of reflecting, in input image data, correction correspond to a change in power consumption associated with control of the luminance of the display panel 10 performed by the luminance control circuit 7.

Second Embodiment

Another embodiment of the present disclosure will be described as follows. Note that, for convenience of description, members having the same functions as those of the members described in the first embodiment are denoted by same reference numerals and a description thereof will be omitted.

The present embodiment is different from the above-described first embodiment in that a correction function (a second correction function) which outputs input luminance (input gray level) as output luminance (output gray level) without change is used if a luminance control circuit 7 sets a luminance setting as low as less than a prescribed value (for example, if the luminance control circuit 7 makes settings such that a gray level of 255 corresponds to a luminance of less than 500 cd).

Figure 6:
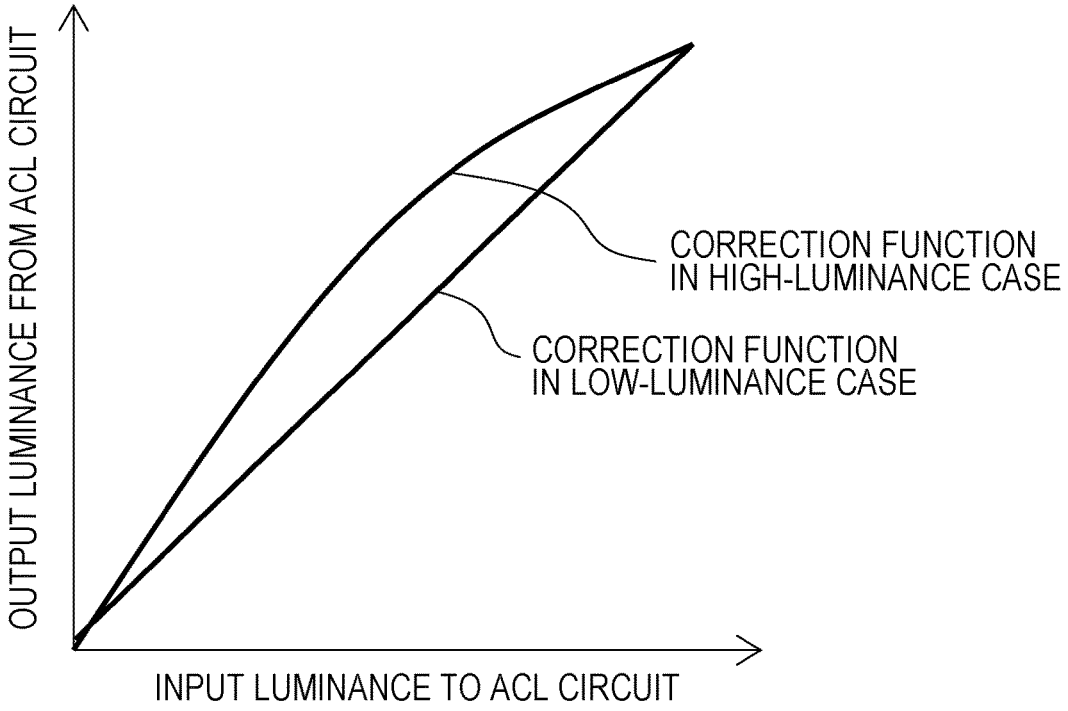
FIG. 6 is a graph showing an example of a correction function to be used in the case where the luminance control circuit sets the display luminance of the display panel low.
Figure 7:
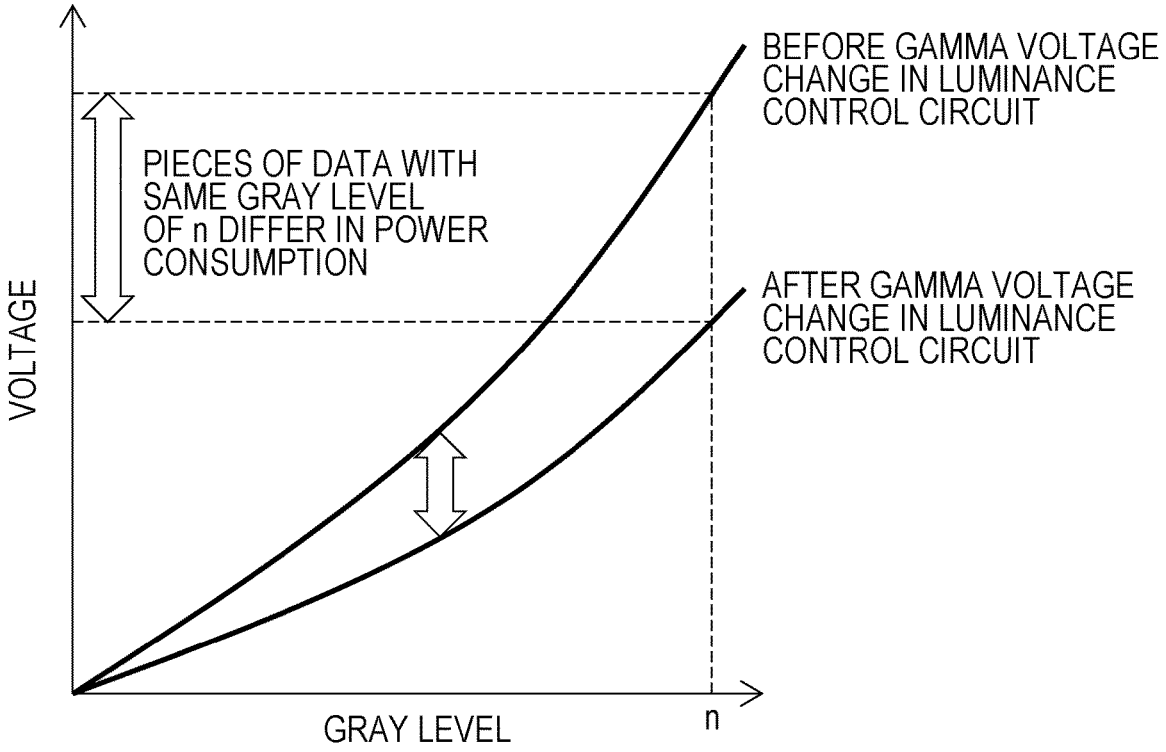
FIG. 7 is a graph showing a case where input gray-level voltage data is subjected to gamma voltage change in a luminance control circuit.

A correction function in a high-luminance case in FIG. 6 is an example of a correction function in a case where the luminance control circuit 7 makes settings such that the gray level of 255 corresponds to a luminance of 500 cd or more. A correction function in a low-luminance case in FIG. 6 is a correction function in a case where the luminance control circuit 7 makes settings such that the gray level of 255 corresponds to the luminance of less than 500 cd.

That is, in the present embodiment, the luminance control circuit 7 is configured to correct input luminance (input gray level) if a value of a luminance control parameter is a value which makes a luminance setting for a display panel 10 not less than a prescribed value (for example, makes the gray level of 255 correspond to the luminance of 500 cd or more) and to output input luminance (input gray level) as output luminance (output gray level) without change if the value of the luminance control parameter is a value which makes the luminance setting for the display panel 10 less than the prescribed value (for example, makes the gray level of 255 correspond to the luminance of less than 500 cd).

As described in the first embodiment with reference to FIG. 5B, if the luminance setting is set low by the luminance control circuit 7, there is little reduction in luminance due to a power drop, and an actually measured gamma curve deviates only slightly from an ideal gamma 2.2 curve with a power drop or an ideal gamma 2.2 curve without a power drop.

Thus, as in the present embodiment, if the luminance control circuit 7 sets the luminance setting as low as less than the prescribed value, a correction function (a second correction function) which outputs input luminance (input gray level) as output luminance (output gray level) without change may be used.

CONCLUSION

A display device according to a first aspect of the present disclosure is a display device including a display panel, a gray-level correction circuit, and a luminance control circuit which controls luminance of the display panel. The gray-level correction circuit acquires a first parameter for generating a first correction function on the basis of luminance-related data of input image data, and corrects the first parameter on the basis of a luminance control parameter related to control of the luminance of the display panel from the luminance control circuit, acquires a second parameter for generating a second correction function, and corrects a gray level of the input image data on the basis of the second correction function.

According to a second aspect of the present disclosure, in the display device of the first aspect, the luminance-related data of the input image data may be a lighting rate which is calculated on the basis of a value obtained by dividing a frame luminance, which is a sum of luminances of all of pixels in the display panel based on the input image data for one frame, by a product of the number of all the pixels in the display panel and a gray-level value indicating maximum luminance.

According to a third aspect of the present disclosure, in the display device of the first or second aspect, the luminance control parameter may include a PWM parameter which is supplied from the luminance control circuit to a PWM control circuit to control the luminance of the display panel.

According to a fourth aspect of the present disclosure, in the display device of any one of the first to third aspects, the luminance control parameter may include a gamma voltage setup value which is supplied from the luminance control circuit to a gamma circuit to control the luminance of the display panel.

According to a fifth aspect of the present disclosure, in the display device of any one of the first to fourth aspects, the luminance control circuit may correct the gray level of the input image data if a value of the luminance control parameter is a value which makes a luminance setting for the display panel not less than a prescribed value.

The present disclosure is not limited to the above-described embodiments, but may be altered within the scope of the claims. An embodiment based on a proper combination of technical measures disclosed in different embodiments is also encompassed in the technical scope of the present disclosure. Additionally, a new technical feature can be formed by combining the technical measures disclosed in the embodiments.

The present disclosure contains subject matter related to that disclosed in Japanese Priority Patent Application JP 2017-231895 filed in the Japan Patent Office on Dec. 1, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

INDUSTRIAL APPLICABILITY

The present disclosure may be used for a display device.

What is claimed is:

1. A display device comprising:

a display panel;

a gray-level correction circuit; and a luminance control circuit which controls luminance of the display panel, wherein the gray-level correction circuit acquires a first parameter for generating a first correction function on the basis of luminance-related data of input image data, corrects the first parameter on the basis of a luminance control parameter related to control of the luminance of the display panel from the luminance control circuit, acquires a second parameter for generating a second correction function, and corrects a gray level of the input image data on the basis of the second correction function, wherein the luminance-related data of the input image data is a lighting rate which is calculated on the basis of a value obtained by dividing a frame luminance, which is a sum of luminances of all of pixels in the display panel based on the input image data for one frame, by a product of the number of all the pixels in the display panel and a gray-level value indicating maximum luminance.

2. The display device according to claim 1, wherein the luminance control parameter includes a PWM parameter which is supplied from the luminance control circuit to a PWM control circuit to control the luminance of the display panel.

3. The display device according to claim 1, wherein the luminance control parameter includes a gamma voltage setup value which is supplied from the luminance control circuit to a gamma circuit to control the luminance of the display panel.

4. The display device according to claim 1, wherein the luminance control circuit corrects the gray level of the input image data if a value of the luminance control parameter is a value which makes a luminance setting for the display panel not less than a prescribed value.

* * * * *